US005211013A

United States Patent [19]

Bonde et al.

[11] Patent Number: 5,211,013

[45] Date of Patent: May 18, 1993

[54] MUFFLER HEAT SHIELD AND METHOD OF ATTACHMENT

[75] Inventors: Kevin G. Bonde, Kiel; Joseph C. Palof, St. Cloud, both of Wis.

[73] Assignee: Tecumseh Products Company, Tecumseh, Mich.

[21] Appl. No.: 761,259

[22] Filed: Sep. 17, 1991

[51] Int. Cl.[5] ..... F01N 7/14

[52] U.S. Cl. ..... 60/323; 29/890.08; 181/240; 181/283; 403/408.1

[58] Field of Search ..... 60/323, 299, 272; 181/283, 240; 29/890.08; 403/28, 30, 179, 404, 405.1, 408.1; 411/368, 371, 531, 546, 547, 915

[56] References Cited

U.S. PATENT DOCUMENTS

| | | | |
|---|---|---|---|
| 3,233,699 | 2/1966 | Plummer | 60/272 |
| 3,795,287 | 3/1974 | Rose | 181/36 |
| 3,863,445 | 2/1975 | Heath | 60/299 |
| 3,963,087 | 6/1976 | Grosseau | 60/299 |
| 4,050,771 | 9/1977 | Watson | 403/408.1 |
| 4,265,332 | 5/1981 | Presnall | 181/283 |
| 4,349,078 | 9/1982 | Shimada | 60/299 |
| 4,370,855 | 2/1983 | Tuggle | 181/240 |
| 4,433,542 | 2/1984 | Shimura | 60/299 |
| 4,478,310 | 10/1984 | Harter | 181/241 |
| 4,612,767 | 9/1986 | Engquist | 60/323 |
| 4,732,519 | 3/1988 | Wagner | 403/408.1 |
| 4,741,411 | 5/1988 | Stricker | 181/283 |
| 4,832,151 | 5/1989 | Araki | 181/211 |
| 4,890,690 | 1/1990 | Fischer et al. | 181/240 |

FOREIGN PATENT DOCUMENTS

| | | | |
|---|---|---|---|
| 1200816 | 8/1970 | United Kingdom | 411/531 |

*Primary Examiner*—Douglas Hart
*Attorney, Agent, or Firm*—Baker & Daniels

[57] ABSTRACT

A nonmetal heat shield that is removably attachable directly to a muffler shell for preventing inadvertent contact with the hot shell surfaces of the muffler. The heat shield includes a plurality of raised boss portions for attaching the heat shield to the muffler shell. A non-metal spacer is located between the bottom surface of the raised boss portion and the fastening portion of the muffler shell to thermally insulate the heat shield from the muffler sufficiently to inhibit thermal degradation of the heat shield.

20 Claims, 4 Drawing Sheets

MUFFLER HEAT SHIELD AND METHOD OF ATTACHMENT

BACKGROUND OF THE INVENTION

The present invention relates generally to muffler heat shields for small internal combustion engines, and more particularly, to a muffler heat shield that is attachable directly to the muffler.

Muffler guards or heat shields are utilized to prevent an operator or nearby bystanders of a small internal combustion engine from burning themselves on the hot muffler surfaces. The majority of heat shields in current use are of metal construction, either from stamped and formed sheet metal or from spaced frames made of welded steel wire. These designs are generally of an open construction to minimize surface area and trapped heat. Metal heat shields generally require a large air gap between the muffler and shield to reduce heat transfer rates and prevent high heat shield surface temperatures. Typically the shield is placed a distance from the muffler of approximately one inch. A problem with metal heat shields is that they occupy space that could be better used for additional muffler volume. In addition, metal heat shields tend to be relatively expensive per item.

Also known are several heat shield designs of plastic construction. These are also of an open construction and are spaced even further away from the muffler since they are formed generally of a low temperature thermoplastic material that cannot withstand a great amount of heat and still maintain structural integrity. The advantages of plastic heat shields over metal heat shields are twofold. First, plastic heat shields are easier to manufacture which generally results in a lower cost part. Second, plastic shields have a low heat transfer coefficient which results in less heat being transferred in and through the heat shield, which thereby results in a lower surface temperature. In addition, the transfer of heat from the heat shield to the skin occurs more slowly, thereby causing less damage to the skin in the event of skin contact with the heat shield surface.

Several methods are currently available for attachment of the heat shields to a muffler. The most common in use is to attach the heat shield to surrounding elements adjacent the muffler, such as the engine block, blower housing, or crankcase. These parts are generally much cooler than the muffler, but are not accurately located relative to the muffler, causing assembly and fit problems. Often, several parts are involved with several attachment points requiring that tolerance stack ups be taken into account. In addition, subassembly is not practical. This method is used for both metal and plastic shield construction.

A second method, applicable only to metal heat shields, is to spot weld or otherwise attach the heat shield permanently to the muffler itself. While this method could be utilized for subassembly, it has a disadvantage in that the assembly must be serviced as a complete unit, so that a damaged shield or muffler would require replacement of both. In addition, the direct metal attachment provides an undesirable heat path from the muffler to the heat shield. Heat shields attached in this manner must be spaced a relatively large distance from the muffler body, creating a large envelope for the muffler and heat shield assembly. In equipment in which space is at a premium, a larger heat shield envelope means less volume for the muffler for sound attenuation.

A third method, again applicable only to metal heat shields, is the use of metal spring clips to attach the heat shield to the muffler. This method is utilized for the muffler constructions having generally a crimped assembly of a number of stamped pieces, which provide a bead for attachment to the spring clip. The crimped bead appears as a parting line for the muffler, extending completely around the perimeter of the muffler. The clips attach to the inside perimeter of the heat shield and snap in place over the crimp bead. Although this method lends itself to subassembly, the clips are metal and therefore transfer heat to the shield. In addition, the crimp beads are not easily held to accurate limits, and tolerance stack ups make controlling part fits difficult.

Another known method of metal heat shield attachment is the use of intermediate supports, such as weld nuts or brackets that are permanently attached to the muffler. The heat shield then attaches to the supports, making the heat shield detachable and serviceable. The supports may also be removably attached. A disadvantage of this method is that it requires extra parts and extra welding operations, thereby adding to overall cost.

It is desirable to provide a heat shield design and a method of assembly that is low in cost, compact in size, highly functional from a safety standpoint, and easy to install or subassemble prior to installation to a muffler or to the engine.

SUMMARY OF THE INVENTION

The present invention provides a nonmetal heat shield that is removably attachable directly to a muffler shell for preventing inadvertent contact with the hot shell surfaces of the muffler, wherein a nonmetal spacer is located between the fastener portion of the heat shield and the fastener portion of the muffler shell. The spacer thermally insulates the heat shield from the muffler sufficiently to inhibit thermal degradation of the heat shield. The combination of the spacer and the nonmetal material forming the heat shield is sufficient to limit the surface temperature of the heat shield within U.S. and European standards. The combination of materials allows these standards to be met while allowing the shield to conform closely to the muffler shell, allowing for maximum utilization of space for the muffler itself.

Generally, the present invention provides a nonmetal heat shield for a muffler of an internal combustion engine, wherein the heat shield is removably attachable directly to the muffler shell. The heat shield includes a peripheral frame, a plurality of reinforcing rib portions, and a raised boss portion for attaching the heat shield to the muffler shell. A nonmetal spacer is located between the bottom surface of the raised boss portion and the fastening portion of the muffler shell upon fastening the heat shield to the shell.

More specifically, the present invention provides, in one form thereof, an opening in the raised boss portion and an eyelet disposed in the opening such that the spacer is located between the inner rim of the eyelet and the bottom surface of the raised boss portion. A wave washer is disposed between the spacer and the heat shield, and the eyelet is then crimped tightly against the raised boss portion to securely retain the spacer and wave washer to the heat shield in a subassembly. Alternately, the spacer may be shaped so that it is molded in place in the heat shield without the need for an eyelet or wave washer. The heat shield may then be subsequently attached directly to the muffler shell by inserting a bolt through the opening in the raised boss portion and into an opening in the muffler shell.

An advantage of the present invention is that heat shield, in one form, may be made of a high temperature thermoset plastic which lends itself to low cost tooling and low cost parts.

Another advantage of the present invention is that the heat shield may be attached directly to the muffler at a very low clearance to maximize muffler volume as well as maintain surface temperatures within acceptable limits.

Yet another advantage of the present invention is that mounting components may be securely attached to the heat shield at a subassembly or may be formed integrally with the shield at its manufacture.

Still another advantage of the present invention is that the heat shield is designed to provide structural integrity, while minimizing material use and maximizing open area.

The present invention, in one form thereof, provides an internal combustion engine having an exhaust system including a muffler having an outer shell. A mounting assembly is provided for removably mounting a nonmetallic heat shield to the muffler shell. The mounting assembly includes a nonmetal spacer disposed between the shield and the shell. The mounting assembly further includes a fastener for fastening the shield to the muffler shell, whereby upon heating of the muffler shell during engine operation, the spacer thermally insulates the shield sufficiently to inhibit thermal degradation thereof.

The present invention further provides, in one form thereof, a method of assembling a nonmetal heat shield directly to a muffler shell of an internal combustion engine. The method includes the step of locating a nonmetal spacer between a fastening portion of the shield and the muffler shell and introducing a fastener into a first opening in the fastening portion and into a second coaxial opening in the muffler shell to removably fasten the shield directly to the muffler shell.

DESCRIPTION OF THE PREFERRED EMBODIMENT

Figure 1:
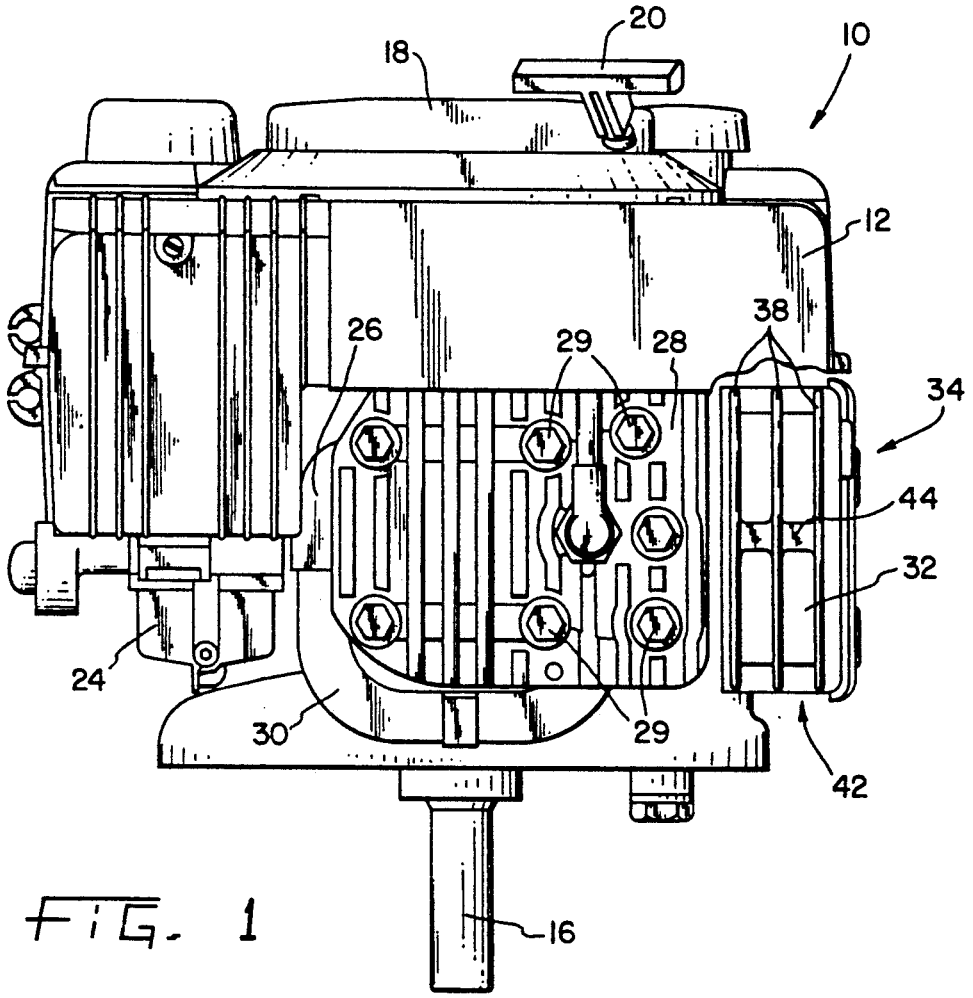
FIG. 1 is a front elevational view of a small internal combustion engine incorporating a muffler heat shield in accordance with the principles of the present invention.
Figure 2:
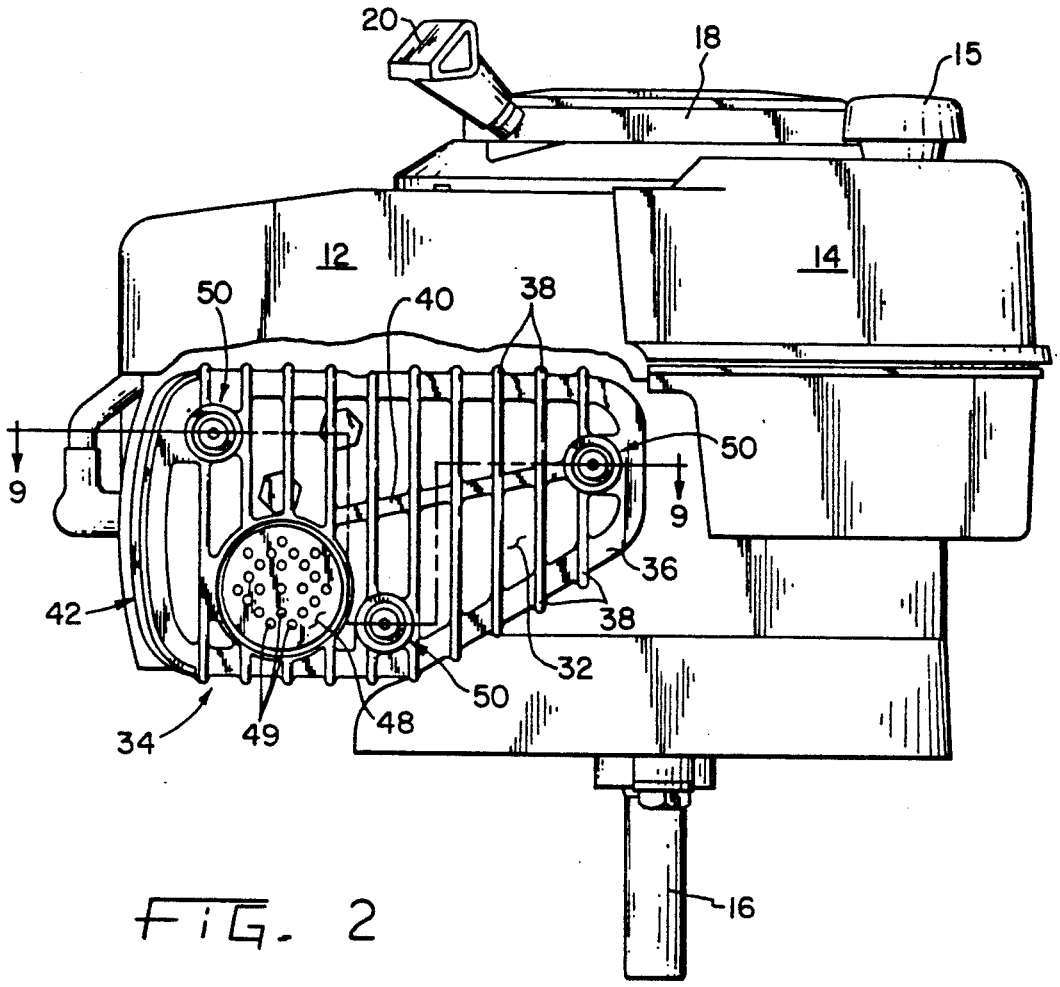
FIG. 2 is a side elevational view of the engine shown in FIG. 1.

Referring now to the drawings, and in particular to FIGS. 1 and 2, there is shown the upper portion of a conventional small air-cooled internal combustion engine 10 of the vertical crankshaft variety as might be used to power a rotary lawn mower, for example. Engine 10 includes a blower housing 12 and a fuel tank 14 including fuel cap 15. Engine crankshaft 16 is keyed to the flywheel (not shown) which includes air circulating blades or vanes (not shown) for air cooling of the engine. The flywheel is enclosed within blower housing 12. A manual recoil starting arrangement (not shown) is positioned above the flywheel and is enclosed within starter housing 18, which is preferably made of stamped steel. Pull-start handle 20 extends from the top surface of starter housing 18. Engine 10 further comprises a carburetor 24, a cylinder block 26, a cylinder head 28, an intake tube 30, and an exhaust system including a muffler 32. Cylinder head 28 is connected to cylinder block 26 by head bolts 29 which are received in bolt holes (not shown) of cylinder block 26. The remaining components of engine 10 (e.g., camshaft, crankcase, piston, etc.) are well known and consequently are omitted for the sake of clarity in the following description.

Figure 3:
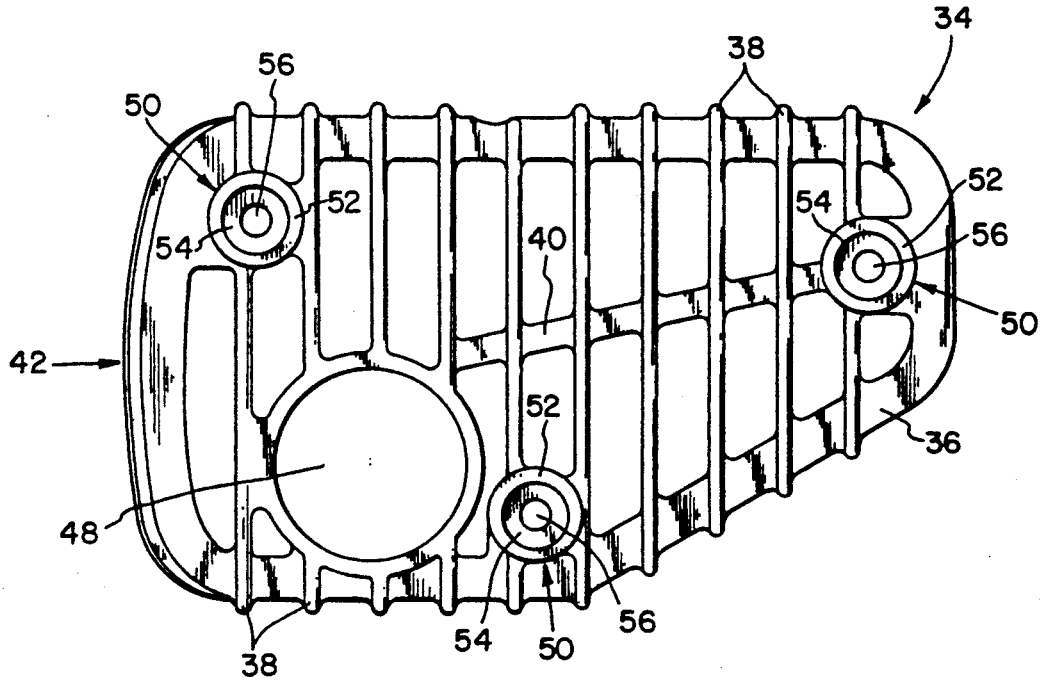
FIG. 3 is an enlarged isolated view of the muffler heat shield shown in FIG. 2.
Figure 10:
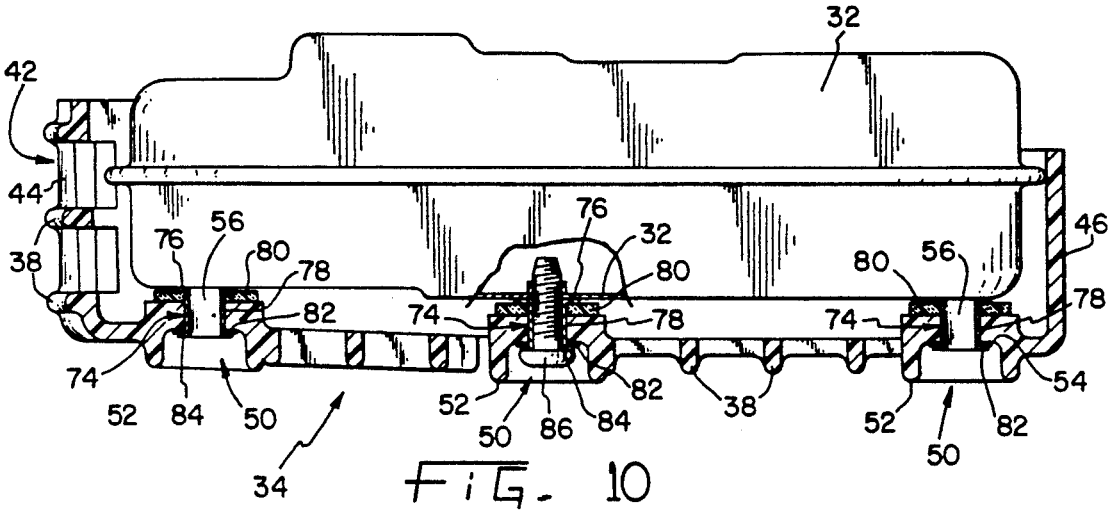
FIG. 10 is a sectional view of the engine shown in FIG. 2 taken along line 9–9 in FIG. 2.

In accordance with one embodiment of the present invention, there is shown in FIGS. 1, 2, and 10, a muffler heat shield 34. Heat shield 34 is made of a nonmetallic material and is preferably formed as a molded shell of high temperature thermoset plastic, such as polyester or phenolic. This material permits the heat shield to be located in close proximity to the muffler (i.e. ¼ inch or less) and still maintain surface temperatures low enough to conform with current U.S. and European standards. More particularly, heat shield 34 generally comprises an enclosed peripheral portion 36 that is shaped to generally match the contour of muffler 32. Heat shield 34 includes a plurality of equally spaced reinforcing ribs 38 extending across peripheral portion 36 as best shown in FIG. 3. A generally axially extending rib 40 is provided for extra strength and reinforcement. As shown in FIGS. 1 and 10, heat shield 34 further includes integrally formed end portions 42 and 46. End portion 42 includes reinforcing ribs 38 and a central rib 44. As best shown in FIG. 10, end portion 46 is solid. These end portions are added and shaped as needed to cover the ends of the muffler.

Heat shield 34 includes an annular opening 48 that is positioned and sized to fit over small gas exhaust apertures 49 of muffler 32 (FIG. 2) when attached thereto. Heat shield 34 further includes a plurality of fastening portions 50, each generally comprising a hollow raised boss having a outer surface 52, an inner rim portion 54, and a smaller concentric opening 56 for receiving a fastener.

Figure 4:
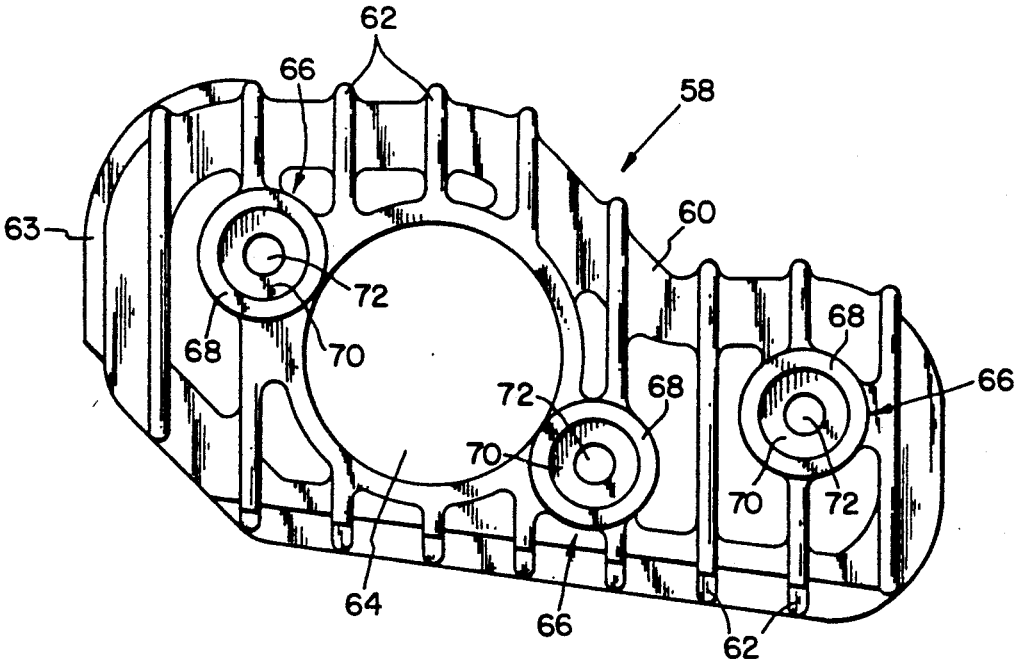
FIG. 4 is a front elevational view of a second embodiment of a muffler heat shield in accordance with the principles of the present invention.

Referring to FIG. 4, there is shown a heat shield 58, which is an alternative embodiment to heat shield 34, and is designed for use in an engine having a different muffler design. It is noted that heat shields 34 and 58 are only two of many possible alternative designs of heat shields that fall within the scope of the present invention. In FIG. 4, heat shield 58 includes an enclosed peripheral portion 60 that is shaped to generally match the outer periphery of a second muffler (not shown). Heat shield 58 includes a plurality of equally spaced reinforcing ribs 62 extending across peripheral portion 60. Heat shield 58 further includes an integrally formed end portion 63 at one axial end thereof and another end portion (not shown) at the opposite axial end. Similar to heat shield 34, shield 58 includes an annular opening 64 that is positioned and sized to fit over the exhaust opening of a muffler. Heat shield 58 also includes a plurality of fastening portions 66, each generally comprising a hollow raised boss having an outer surface 68, a reduced diameter portion having an inner rim portion 70, and a smaller concentric opening 72 for receiving a fastener.

Referring now to FIGS. 5-9, there are shown a variety of embodiments for mounting a heat shield of the present invention to muffler shell 32, wherein a relatively low clearance (¼ inch or less) is achieved between the heat shield and muffler. In a preferred embodiment shown in FIG. 5, a hollow rivet or eyelet 74 is provided having an annular rim portion 76 at its inner axial end and a hollow cylindrical portion 78. In order to help maintain surface temperatures at an acceptable level as well as inhibit thermal degradation of heat shield 34 while it is attached to muffler shell 32, a nonmetal spacer 80 is provided and includes a central opening which receives cylindrical portion 78 so that spacer 80 may be supported between rim 76 and the inner surface of raised boss 50 of heat shield 34. For purposes of clarity, the term "thermal degradation" means a breakdown of the material forming the shield due to heat, including a loss of physical properties and/or of actual material.

Figure 5:
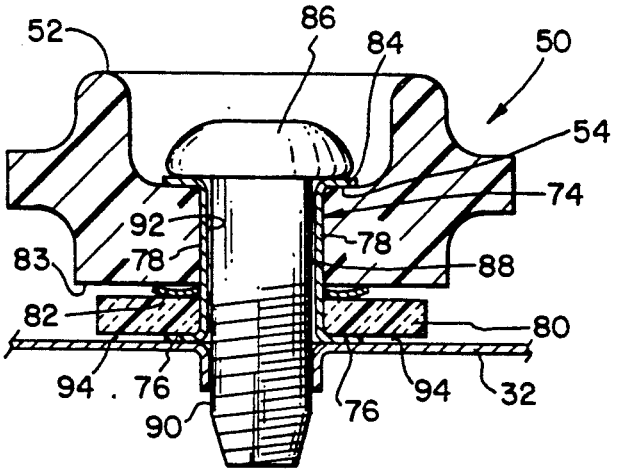
FIG. 5 is a sectional view of one of the mounting assemblies for mounting the muffler heat shield shown to the muffler shell, as shown in FIG. 2.

When installed on muffler 32, as shown in FIG. 5, spacer 80 provides thermal insulation to heat shield 34 from muffler 32. In addition, depending on the material used, spacer 80 may function as a spring to take up tolerances in the assembly to effectively retain heat shield 34 in place. Spacer 80, which in a preferred embodiment, is in the form of a ceramic annular disc, may be made from a wide variety of other materials such as high temperature plastics, high temperature gasket materials, etc., and can be stamped out of sheet stock or molded in a die.

In order to provide additional resiliency or "springiness" to the mounting assembly, a spring element such as wave washer 82 is provided between the bottom surface 83 of raised boss portion 50 and spacer 80, in a preferred embodiment. The spring element compensates for relaxation of the joint due to time and temperature effects. It is noted that wave washer 82 may be located anywhere in the assembly, such as on rim 54 of raised boss portion 50. Other spring elements may be utilized in place of wave washer 82, such as a Bellville spring washer or a coil spring. If thermal insulating properties are more important than maintaining resiliency in the assembly, an outer spacer (not shown) may be disposed on rim 54 of raised boss portion 50 in place of or in addition to a wave washer. Eyelet 74 is then crimped to form an outer rim 84 to complete the assembly. In addition, pressure is applied between inner rim 76 and outer rim 84 of eyelet 74 to preload the spring element and tightly retain all components to mounting boss portion 50. Thus, eyelet 74 allows for easy subassembly of the mounting components of heat shield 34 so that heat shield 34 may be conveniently attached to muffler 32 at a separate assembly by a fastener such as a standard bolt 86.

Referring again to FIG. 5, bolt 86 is torqued in conventional fashion to removably attach raised boss portion 50 of heat shield 34 to muffler 32. Once bolt 86 is attached to the mounting assembly, a small air gap 88 is formed between cylindrical bolt outer wall 90 and inner wall 92 of eyelet cylindrical portion 78. An additional air gap 94 is provided between muffler 32 and spacer 80 in the area radially outward of the radius of eyelet rim portion 76. Air gaps 88 and 94 provide additional thermal insulation between muffler 32 and raised boss portion 50 of heat shield 34. It is realized that several variations to this embodiment are possible. For example, wave washer 56 may be excluded if desired.

Figure 6:
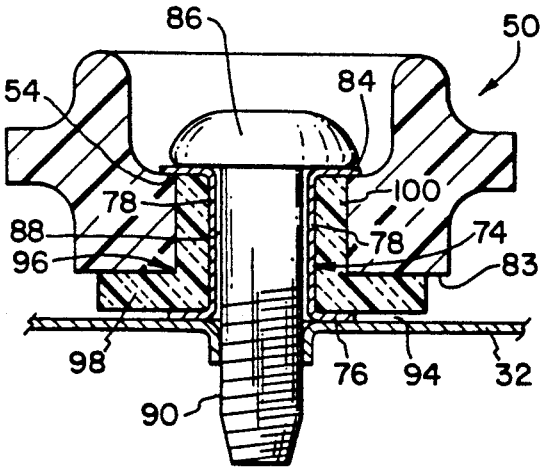

Referring to FIG. 6, an alternative embodiment to the mounting assembly of FIG. 5 is shown, to provide even more insulation between heat shield 34 and muffler 32. In this embodiment a spacer 96 is provided having a flat disc portion 98 and a tubular portion 100. Spacer 96 is preferably molded from a nonmetallic material, such as a high temperature thermoset plastic or a ceramic. As shown in FIG. 6, spacer 96 is fitted within eyelet 74, which is crimped to permanently attach spacer 96 to raised boss 50 of heat shield 34. This mounting assembly is primarily designed for nonmetal heat shields which cannot withstand the heat conducted thereto from bolt 86. It is noted that a shoulder bolt may be utilized in place of standard bolt 86 and eyelet 74. Also, a spring element may be added to the assembly as required.

In instances in which an eyelet 74 is utilized in the mounting assembly and the spacer element is made of a relatively soft material such as plastic, mineral wool, or a fiber glass composite, an additional thin washer (not shown) may be disposed between rim portion 76 of eyelet 74 and the spacer element, such as spacer 80 of FIG. 5. Since the soft spacer element may not be able to withstand assembly forces, the washer element serves to distribute loads and prevent the spacer from cracking and breaking under pressure. Preferably, the washer is made of hardened steel and is shaped to match the diameter of the spacer.

Figure 7:
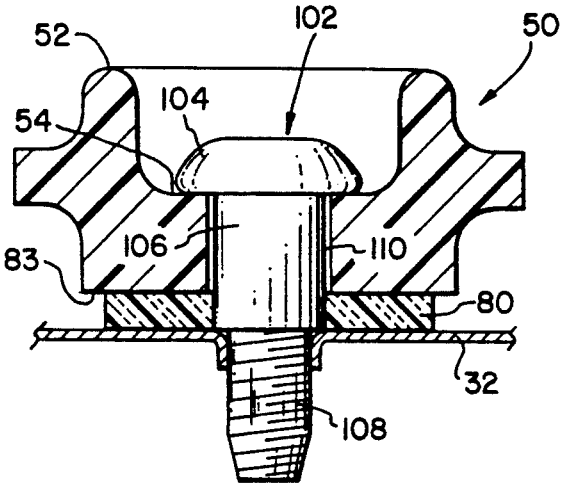
FIGS. 6–9 show alternative embodiments to the mounting assembly shown in FIG. 5.
Figure 8:
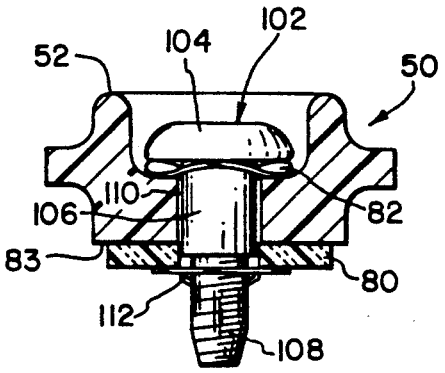

Yet another embodiment for mounting heat shield 34 to muffler 32 is shown in FIG. 7. In this embodiment, a shoulder bolt 102 is utilized including a head 104, a shank 106, and threaded portion 108. A shoulder bolt is advantageous in that it permits the amount of torque or "crush" on the mounting assembly to be controlled and eliminates the need for an eyelet. As shown, an air gap 110 is formed between raised boss portion 50 and shank 106 to provided additional thermal insulation therebetween. In FIG. 8, a wave washer 82 is located between bolt head 104 and rim portion 54, however, again, the location of wave washer 82 may vary within the mounting assembly. In addition, a conventional push nut 112 is provided to permit complete subassembly of the mounting components.

Figure 9:
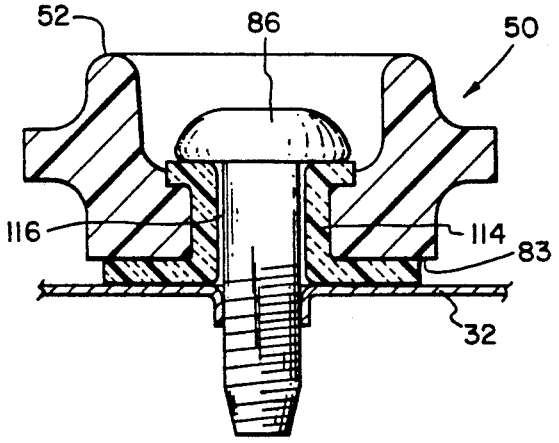

Referring to FIG. 9, still another alternative embodiment to the mounting assembly is shown, wherein a spacer 114 is shaped and molded integrally into raised boss portion 50 during heat shield manufacture, thereby reducing subassembly parts and costs. Spacer 114 is preferably made of a ceramic material. Upon assembly, an insulating air gap 116 is formed between bolt 86 and spacer 114.

As still another alternative embodiment, the heat shield may be made of nonmetal material that is attachable directly to the muffler shell without the use of spacers. Examples of a heat shield of this type are those made from a very high temperature plastic, such as thermoset silicones or thermoplastic polyamideimides. These materials can withstand the high temperatures which occur during engine operation without being subject to thermal degradation. Consequently, no thermally insulating spacers are necessary. Presently, these high temperature materials are relatively expensive, which may limit their use.

It will be appreciated that the foregoing is presented by way of illustration only, and not by way of any limitation, and that various alternatives and modifications may be made to the illustrated embodiments without departing from the spirit and scope of the invention.

What is claimed is:

1. An internal combustion engine comprising:

an exhaust system including a muffler having an outer shell;

a nonmetallic heat shield; and mounting means for removably mounting said shield to said shell, said mounting means including a nonmetal spacer disposed between said shield and said shell, said mounting means further including fastener means for fastening said shield to said shell, whereby upon heating of said shell during engine operation, said spacer thermally insulates said shield sufficiently to inhibit thermal degradation of said shield.

2. The engine according to claim 1, wherein said spacer is integral with said shield.

3. The engine according to claim 1, wherein said mounting means includes spring element means for providing resiliency thereto.

4. The engine according to claim 3, wherein said spring element means comprises a wave washer that is located between said shield and said spacer.

5. The engine according to claim 1, wherein said shield includes a generally cylindrical raised boss portion having an outer surface and an inner surface and having an opening therein, wherein a hollow tubular eyelet is disposed in said opening and includes an inner end rim, said spacer being secured between said inner surface and said inner end rim.

6. The engine according to claim 5, wherein said tubular eyelet includes an outer end rim and said raised boss portion includes a reduced diameter portion defining an inner rim portion, wherein one of a second spacer and a wave washer is disposed between said outer end rim and said inner rim portion.

7. The engine according to claim 1, wherein said spacer includes a disc portion and a tubular portion, wherein said disc portion is located between said shield and shell and said tubular portion is located between said fastener means and said shield.

8. The engine according to claim 1, wherein said shield includes an inner wall defining a first opening therein and said shell includes a second opening therein that is coaxial with said first opening, said fastener means comprising a bolt having a generally cylindrical portion, wherein said bolt is disposed in said first opening and said second opening to securely attach said shield to said shell, wherein an insulating air gap is formed between said cylindrical portion and said inner wall.

9. A nonmetal heat shield for preventing inadvertent contact with a hot outer shell surface of a muffler, comprising:

an enclosed peripheral portion that is shaped to generally correspond to the outer periphery of the muffler;

a plurality of reinforcing rib members extending across said peripheral portion; and insulated fastener means for removable attachment of said shield directly to the muffler surface, wherein said fastener means includes a thermal insulator for insulating said shield from the hot muffler surface sufficiently to inhibit thermal degradation of the shield while said shield is attached to the muffler surface.

10. The heat shield according to claim 9, wherein said thermal insulator is integral with said shield.

11. The heat shield according to claim 9, wherein said shield is made from a high temperature thermoset plastic.

12. The heat shield according to claim 9, wherein said fastener means includes spring element means for providing resiliency thereto.

13. The heat shield according to claim 9, including a generally cylindrical raised boss portion having an outer surface and an inner surface and having an opening therein, wherein a hollow tubular eyelet is secured in said opening and includes an inner end rim and an outer end rim, wherein said thermal insulator comprises a nonmetal spacer that is secured between said inner surface and said inner end rim.

14. The heat shield according to claim 13, wherein a wave washer is disposed between said inner surface of said raised boss portion and said spacer.

15. An internal combustion engine comprising:

an exhaust system including a muffler having an outer shell;

a heat shield predominantly made of at least one of a thermoplastic polymer material and a thermoset polymer material that resists thermal degradation upon engine operation; and mounting means for removably mounting said shield directly to said shell.

16. An internal combustion engine comprising:

an exhaust system including a muffler having an outer shell;

a heat shield made of one of a thermoset silicone and a thermoplastic polyamideimide; and mounting means for removably mounting said shield directly to said shell.

17. A method of assembling a nonmetal heat shield directly to a muffler shell of an internal combustion engine, the method comprising the steps of:

locating a nonmetal s-pacer between a fastening portion of said shield and the muffler shell, whereby upon heating of said shell during engine operation, said spacer thermally insulates said shield sufficiently to inhibit thermal degradation of said shield; and introducing a fastener into a first opening in said fastening portion and into a second coaxial opening in the muffler shell to removably fasten the shield directly to the shell.

18. The method according to claim 17, wherein said fastening portion comprises a raised boss portion having an outer surface and an inner surface and including the steps of:

inserting a hollow tubular eyelet having an inner end rim into said first opening after the step of locating said spacer, wherein said spacer is positioned between said inner end rim and said inner surface; and crimping said eyelet sufficiently to secure said spacer to said inner surface of said raised boss portion.

19. The method according to claim 18, including the step of:

disposing one of a spring element and a spacer between said inner surface and spacer.

20. The method according to claim 19, wherein said spring element comprises a wave washer.

* * * * *